United States Patent [19]

LoCascio

[11] 4,347,827

[45] Sep. 7, 1982

[54] NOISE BLANKER CIRCUIT FOR USE WITH ELECTRONIC IGNITION SYSTEMS OR THE LIKE

[75] Inventor: James J. LoCascio, Mesa, Ariz.

[73] Assignee: Motorola, Inc., Del.

[21] Appl. No.: 269,149

[22] Filed: Jun. 1, 1981

[51] Int. Cl.[3] ..... F02D 1/00

[52] U.S. Cl. ..... 123/618; 123/645; 307/542

[58] Field of Search ..... 123/618, 645, 646, 633; 307/542–551

[56] References Cited

U.S. PATENT DOCUMENTS

| | | | |
|---|---|---|---|
| 3,052,850 | 9/1962 | Fluhr | 307/544 X |
| 3,898,482 | 8/1975 | Holt, Jr. | 307/542 |
| 3,960,129 | 6/1976 | Hofer et al. | 123/599 |
| 4,008,698 | 2/1977 | Gartner | 123/644 X |
| 4,248,200 | 2/1981 | Sugiura et al. | 123/644 |

*Primary Examiner*—Tony M. Argenbright
*Attorney, Agent, or Firm*—Michael D. Bingham

[57] ABSTRACT

A circuit suitable to be utilized in an electronic ignition system or the like which receives periodic signal information and which is caused to ignore this information during a portion of each period a predetermined time interval after initiation of each period. The circuit comprises a blanking circuit which is responsive to control signals generated from the input signal information at the predetermined time interval after initiation thereof to produce a blanking signal the duration of which last during the portion of the period and a coincidence gate that is inhibited by the blanking signal but enabled during the remaining portion of each period to pass the signal information between an input and output thereof.

12 Claims, 3 Drawing Figures

I LIMIT
RUN
Vbat
Vref
DWELL
I LIMIT
RUN
25%
Vh
Vl
Vcc
I
4I
"1"
10
12
14
16
18
20
22
24
26
28
30
32
34
36
38
40
42
44
46
48
50
52
54
58
60
62
64
66

NOISE BLANKER CIRCUIT FOR USE WITH ELECTRONIC IGNITION SYSTEMS OR THE LIKE

BACKGROUND OF THE INVENTION

1. Field of the Invention

This invention relates to electronic ignition systems or the like and more particularly to a noise blanker circuit for use therein to inhibit false signals from being generated due to system noise transients.

2. Description of the Prior Art

Electronic ignition systems which are operated in timed relationship to an automobile engine rpm for controlling a charge and discharge of an ignition coil to generate spark to operate the engine are well known in the art. Some contemporary ignition systems utilize adaptive dwell to control the power dissipated in the high energy ignition coil according to engine rpm. For example, FIG. 1 illustrates an adaptive dwell ignition system wherein the dwell current in the ignition coil is initiated anywhere from 25%–90% after the initiation of a firing cycle depending upon the engine rpm and the current ramp time of the ignition coil as is generally understood. Because the ignition coil is a high energy device the current through the coil ramps very fast since the RL time constant of the coil is very low. Hence, voltage noise transients can be produced across the windings of the coil that may be equal to 2,000 volts or more. It has been observed that these voltage transients can be both inductively and capacitively coupled to the inputs of the ignition system and have a deleterious effect on the operation thereof. For example, in normal operation of the ignition system the coil dwell current is produced some time after the first 25% time period of the firing cycle and is allowed to ramp up through the coil to a maximum current value at which time the current is limited. At the end of the firing cycle, in response to the initiation of the next succeeding firing cycle, a spark command signal is generated by the ignition system to cause the coil to be discharged which creates the spark necessary to operate the engine. It has been observed that due to the low RL time constant to the coil that the dwell current therethrough produces voltage transients across the windings of the coil to cause the ignition system to generate what appears to be a valid spark command signal. This can cause a misspark or no spark to occur at the correct time during the firing cycle period which may damage the engine. These voltage transients normally decay to a sufficiently low level within 1½ milliseconds after initiation of the coil current.

Thus, there is a need for a blanking circuit to be utilized in combination with an electronic ignition system or the like that requires a minimal number of components for blanking out a portion of each periodic signal input supplied thereto for a predetermined time interval after initiation of each period in order to prevent false output signals from occurring at the output of the system due to noise transients.

SUMMARY OF THE INVENTION

Accordingly, it is an object of the present invention to provide a blanking circuit for use with an electronic ignition system or the like to inhibit noise transients coupled to the inputs of the system from deleteriously affecting the operation thereof.

In accordance with the above and other objects there is provided a noise blanking circuit in combination with an adaptive dwell ignition system which charges and discharges an ignition coil in response to input signals supplied in an input thereof in time relationship to the operation of an engine. The noise blanking circuit is responsive to the ignition system generating a dwell current for inhibiting the system from responding to noise transients occurring thereafter until such time that the magnitude of the dwell current reaches a predetermined value. The noise blanking circuit comprises a blanking signal circuit for providing a blanking signal for a predetermined time interval after initiation of the dwell current and a coincidence circuit responsive to an input thereof at all times except when the blanking signal is supplied thereto which inhibits the operation of the coincidence circuit.

DETAILED DESCRIPTION OF THE INVENTION

Figure 1:
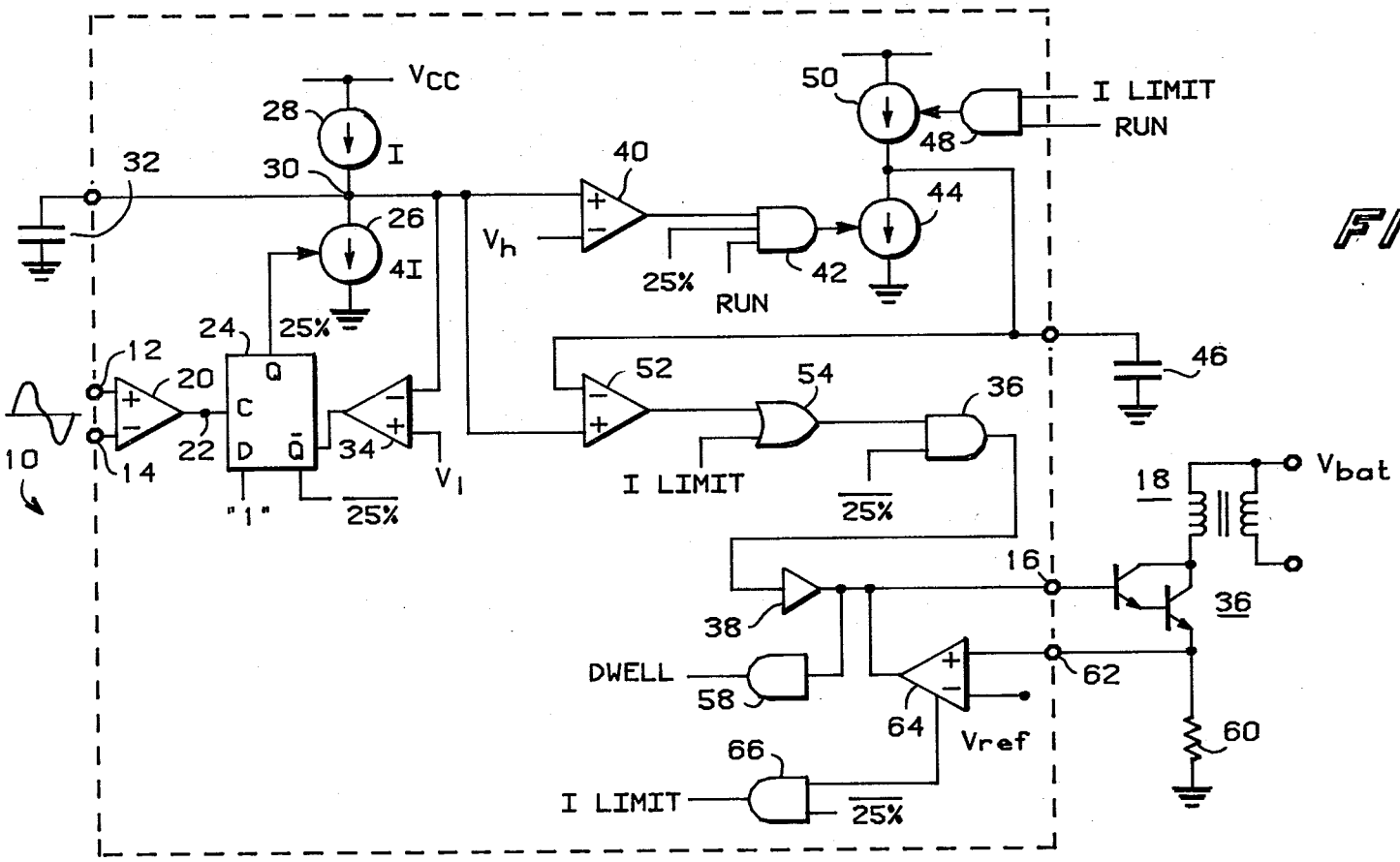
FIG. 1 is a partial block and schematic diagram of an adaptive dwell ignition system.

Turning to FIG. 1 there is shown adapative dwell electronic ignition system 10 which is suitable to be manufactured in integrated circuit form of which the operation is generally understood by those skilled in the art. Electronic ignition system 10 receives timing signals at inputs 12 and 14 which are generated in timed relationship to an automobile engine and provides dwell current at output terminal 16 to charge ignition coil 18 to a predetermined maximum current level at which level the current is limited prior to the ignition system generating a fire command to cause discharge of the ignition coil to generate spark in the engine. Briefly, in response to the timing signals supplied thereto, a generally square wave output signal is produced at the output of comparator 20 at node 22 in the form as shown in FIG. 2A. Therefore, in response to the ignition timing signals crossing a zero axis in a positive direction, the output of comparator 20 goes positive to clock D-flip-flop 24 to produce a logic one at the Q output thereof to render current source 26 operative. Current source 26 as well as current source 28 are connected at node 30 to capacitor 32 such that this capacitor is caused to be discharged at a rate proportional to 3I until such time that the voltage potential thereacross decreases below the bias voltage $V_1$ which causes comparator 34 to reset flip-flop 24. As flip-flop 24 is reset current source 26 is rendered nonconductive to allow charging of capacitor 32 at a rate proportional to the current I supplied from current source 28. Bias voltage $V_1$ has a magnitude which under normal engine and ingition system operating conditions cause capacitor 32 to be discharged for 25% and charged for the remaining 75% of each firing cycle time interval. Hence, logic gate 36 is inhibited during the first quarter cycle of each firing cycle as an input thereto is provided by the $\overline{Q}$ output from flip-flop 24. Thus, predriver amplifier 38 is maintained in a nonconductive state so that dwell current cannot be produced at output terminal 16 of ignition system 10 during the first 25% of each firing cycle. Capacitor 32 is also coupled to the noninverting input of comparator 40 to produce an output therefrom until such time that the capacitor is discharged to a value equal to the bias voltage $V_h$. A coincident gate 42 is provided for rendering current source 44 operative to discharge an adaptive dwell capacitor 46 whenever the inputs thereto are at a logic one level. All of the inputs to coincidence gate 42 will be at a logic one whenever the engine is operating (not in a stall condition), the output from comparator 40 is high and the Q output of D flop 24 is at a logic one. Hence, adaptive dwell capacitor 46 is discharged by current source 44 during the first quarter cycle of each firing cycle. Thereafter, with coincident gate 42 being inhibited, the potential across the adaptive dwell capacitor is maintained substantially constant until coincidence gate 48 is enabled by the current through the ignition coil 18 being limited at time $t_3$ (FIG. 2C) which enables current source 50 to charge the adaptive dwell capacitor 46 at a rate proportional to the current supplied thereto until time $t_4$ when the ignition coil 18 is discharged. Amplifier 38 is maintained in an off condition until such time that the magnitude of the potential appearing across capacitor 32 exceeds the threshhold magnitude across adaptive dwell capacitor which provides an output from comparator 52 to AND gate 54. Assuming that the $\bar{Q}$ output of flip-flop 24 is high (which occurs during the last 75% of each firing cycle time interval) coincidence gate 36 is enabled by the output from AND gate 54 to turn on preamplifier 38 to provide base drive to the external Darlington power amplifier 56 which produces dwell current in ignition coil 18. Simultaneously, a dwell signal is generated at the output of logic gate 58 whenever dwell current flows in ignition coil 18. The dwell current ramps up through ignition coil 18 between $t_1$–$t_3$ (FIG. 2C) until a voltage is developed across sense resistor 60, which is applied at terminal 62 to the noninverting input of comparator 64, becomes greater than the potential $V_{ref}$ which is applied to the inverting input thereof. Thus, when the voltage across sense resistor exceeds $V_{ref}$ comparator 64, which has an output coupled to output terminal 16, linearally regulates the current through amplifier 56 to limit the current through ignition coil 18. Simultaneously, an output is generated from comparator 64 to coincidence gate 66 which produces a logic output signal $I_{LIMIT}$ to enable coincidence gate 48. At time $t_4$, in response to the timing signals at terminals 12 and 14 crossing a zero axis in a positive direction, the output from comparator 20 is switched to an upper level state (FIG. 2A) which again clocks flip-flop 24 whereby the Q output goes to a logic zero state to inhibit coincidence gate 36 which in turn renders amplifiers 38 and 56 nonconductive to discharge the coil.

A problem arises in ignition system 10 due to the high energy ignition coil producing high voltage transients across the secondary winding thereof whenever the coil is turned on as is shown at time $t_1$ of FIG. 2A. These voltage transients produce erroneous switching of comparator 20 and can adversely affect the operation of the ignition system. Blanking circuit 68 illustrated in FIG. 3 prevents these voltage transients from effecting the operation of the ignition system as will be hereinafter explained.

Blanking circuit 68 is adapted to be coupled between node 22 and the clock input of D-flip-flop 24 and comprises a blanking circuit portion 70 and a coincidence circuit 72 which utilize known integrated injection logic ($I^2L$) technology for fabrication of the coincidence gates hereinafter referred to. Blanking circuit portion 70 includes a current mirror circuit 74, transistor 76 and coincidence gate 78. Current mirror 74 and transistor 76 forming a comparator circuit with current mirror 74 including transistors 80 and 82 with transistor 80 being connected as a diode having its collector connected in common to the base thereof. The emitter of transistor 80 is connected to a reference potential the magnitude of which is equal to one-half $V_{ref}$ where $V_{ref}$ is equivalent to the magnitude at which the current through ignition coil 18 is limited. A current source 84 sources current to the collector and base of transistor 80 and has a magnitude associated therewith which is substantially equal to the magnitude supplied by current source 86 to node 88. Transistor 82 of current mirror 74 has its collector coupled to node 88, its base connected in common with the base of transistor 80 and its emitter coupled to node 62, across sense resistor 60. The output of current mirror 74 is taken at the collector of transistor 82 and is supplied to transistor 76 which has its base connected to node 88 and its emitter to ground reference. Coincidence gate 78, the input of which is coupled to the collector of transistor 76 and to electronic ignition system 10 for receiving a dwell signal as shown in FIG. 2B. Coincidence gate 78 has a pair of outputs connected across the input and output of coincidence gate 90 and to the respective inputs of coincidence gates 92 and 94 respectively of coincidence circuit 72. The output of comparator 20 is coupled at node 102 to the inputs of coincidence gates 90 and 92. The output of coincidence gate 92 is connected to an input of coincidence gate 96 and output of which is connected to the clock input of flip-flop 24 via lead 98. The output of coincidence gate 94 is connected to the input of coincidence gate 100 with the output thereof cross-connected to the input of coincidence gate 96 which has a second output cross-connected to the input of gate 100.

Figure 2:
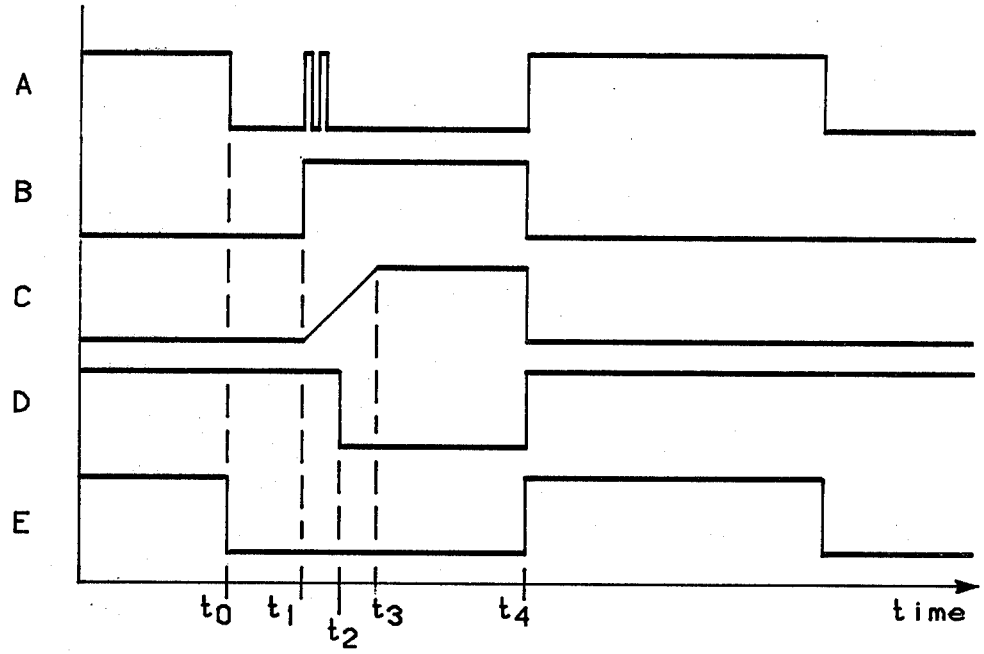
FIG. 2 illustrates wave forms useful for understanding the operation of the blanking circuit of the preferred embodiment of the invention.
Figure 3:
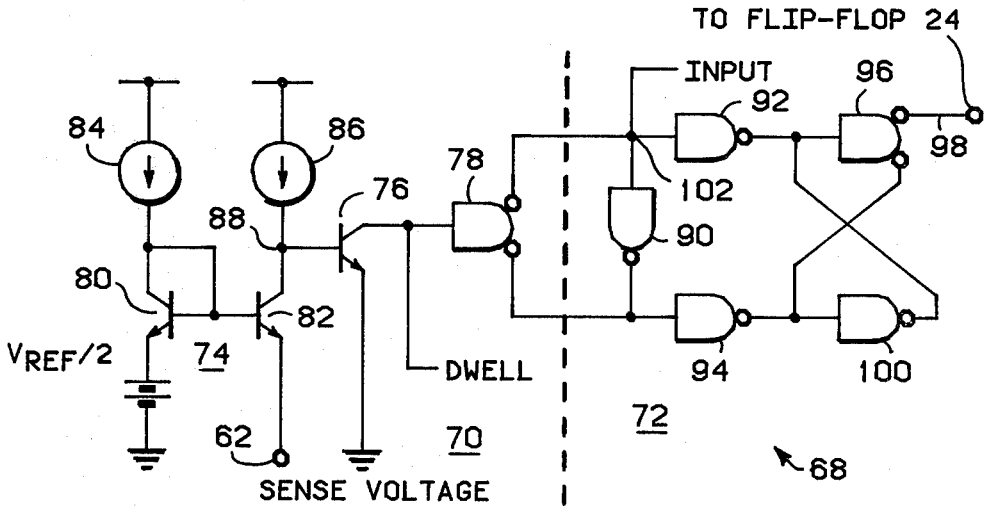
FIG. 3 is a schematic diagram of a blanking circuit of the preferred embodiment of the invention.

Referring to FIG. 2 the operation of blanking circuit 68 can be fully described. For explanation purposes, it is assumed that the timing signal supplied to input terminals 12 and 14 of ignition system 10 have crossed a zero axis in a negative direction at time $t_0$ such that the output from comparator 20 (FIG. 2A) has switched to a low level state which corresponds to a "zero" logic input at node 102 of logic circuit 68. Assuming at $t_0$ the potential across capacitor 32 is less than the threshold potential appearing across adaptive dwell capacitor 46, amplifier 38 is in a nonconductive state such that a logic zero appears at the output of gate 58 which corresponds to the dwell signal (FIG. 2B) being zero at time $t_0$. Without a dwell control signal, no dwell current flows in ignition coil 18 as seen in FIG. 2C whereby the voltage across sense resistor 60 is nominally zero. In this state, transistor 82 of current mirror 74 is in a saturated state such that transistor 76 is rendered nonconductive. This provides a logic "one" to the input of coincidence gate 78. Hence, with the dwell control signal (FIG. 2B) being applied to the input of coincidence gate 78, the output therefrom is at a logic one which allows the output of coincidence circuit 72 to follow the input supplied thereto at node 102 wherein the output via lead 98 at time $t_0$ is forced to go to a low state (FIG. 2E). Thus, as long as the dwell control signal is zero, the output from logic circuit 72 follows the output signal appearing at the output of comparator 20. At time $t_1$, when amplifier 38 is rendered conductive to produce dwell current to ignition coil 18, dwell control signal (FIG. 2B) goes from a logic zero state to a logic one state which thereby causes the outputs of coincident gate 78 to go to a logic zero. Hence, the output of coincidence circuit 72 is latched in a low level output condition whereby the circuit cannot respond to any changes in the output level state of the output signal supplied from comparator 20 to the input thereof at node 102. Therefore, the corrected input to the clock input of D-type flip-flop 24 remains in a low level state from time $t_0$ to time $t_2$ regardless of the output level state of comparator 20. Hence, the voltage transients which appear on the output of comparator 20 (FIG. 2A) do not appear at the output of logic circuit 72, the corrected input to flip-flop 24 of ignition system 10. However, at time $t_2$ when the current through ignition coil 18 has ramped up to a value which produces a voltage across sense resistor 60 substantially equal to one-half $V_{ref}$, current mirror 74 becomes balanced such that any incremental change in the coil current causes base current drive to be supplied to the base of transistor 76 to render this transistor conductive to supply a logic zero to the input of coincidence gate 78. Thereafter, coincidence circuit 72 will respond to the output signal state from comparator 20 since the output of coincident gate 78 is now a logic one. Thus, at time $t_4$, when the output of comparator 20 goes to a high level output state the output from logic gate 96 correspondingly changes to a high output level state.

Hence, what has been described above, is a novel blanking circuit for use in combination with an adaptive dwell electronic ignition system wherein a predetermined time delay is generated after initiation of dwell current wherein any input signals supplied to the ignition system are blanked which inhibit noise transients from erroneously causing the ignition system to generate spark command signals. This time delay is generated by sensing the ignition coil current and causing the ignition system to remain in a latched state until such time that the magnitude of the coil current has reached approximately one-half its final value. Typically this time delay occurs for approximately two milliseconds following ignition coil turn on which is sufficient to allow any voltage transients caused by the ignition coil being turned on to decay down to a sufficiently low enough level as not to deleteriously affect the ignition system.

I claim:

1. A circuit having an input and an output which is responsive to periodic input signals applied to the input for transferring the same to the output at which is connected load circuit means, the circuit being made nonresponsive to changes in the input signals which can occur during a portion of each period of each individual input signal a predetermined time interval after initiation of each periodic input signal due to noise transients being coupled onto each periodic input signal, comprising:

blanking circuit means responsive to control signals generated in response to each periodic input signal for producing a blanking signal at an output thereof during the portion of each period; and coincidence circuit means having an input and output, said input being coupled both to said output of said blanking circuit means and the input of the circuit, said output being coupled to the output of the circuit, said coincidence circuit means transferring the periodic input signals between said input and output except during the portion of each period when said coincidence circuit means is inhibited by said blanking signal.

2. The circuit of claim 1 wherein said blanking circuit means includes:

comparator means having an output which is responsive to the magnitude of one of said control signals reaching a predetermined value sometime after the predetermined time interval after initiation of each individual periodic input signal for changing from a first level state to a second level state; and a first coincidence gate coupled to said output of said comparator means and receiving a second one of the control signals for producing said blanking signal at said output of said blanking circuit means upon coincidence of said second control signal and said comparator means output being in said first level state.

3. The circuit of claim 2 wherein said comparator means includes:

a current mirror circuit adapted to receive said first control signal and a reference potential at respective inputs, said current mirror circuit supplying an output current at an output thereof in response to said magnitude of said first control signal exceeding the magnitude of said reference potential; and output circuit means coupled between said output of said current mirror circuit and said output of said comparator means for causing the output of said comparator to switch to said second output level in response to said current supplied by said current mirror circuit to the input thereof.

4. The circuit of claim 3 wherein said output circuit includes a transistor having first, second and control electrodes, said first electrode being coupled to a terminal at which is supplied ground reference potential, said second electrode being coupled to said output of said comparator means, said control electrode being coupled to said output of said current mirror circuit.

5. The circuit of claim 4 wherein said first coincidence gate having a second output coupled to said coincidence circuit means.

6. The circuit of claim 5 wherein said coincidence circuit means includes:

a second coincidence gate having an input and output, said input being coupled to said input of said coincidence circuit means;

third and fourth coincidence gates each having an input and an output, said input of said third coincidence gate means being coupled to said input of said coincidence circuit means, said input of said fourth coincidence gate being coupled to said second output of said first coincidence gate and to said output of said second coincidence gate; and latch circuit means having first and second inputs respectively coupled to said outputs of said third and fourth coincidence gates and an output coupled to said output of the coincidence circuit means.

7. In an ignition system responsive to periodic timing signal information generated in timed relationship to an engine rpm for producing dwell current a predetermined time interval after initiation of each timing signal information period to an ignition coil, a circuit for causing the ignition system to ignore the timing signal input information for a predetermined portion of each period occurring after the predetermined time interval when the dwell current is initiated, comprising:

a blanking circuit responsive to the dwell current being produced for producing a blanking signal at an output the duration of which lasts for said predetermined portion of each period; and a coincidence circuit having an input coupled to said output of said blanking circuit and receiving said timing signal information and an output, said coincidence circuit being inhibited by said blanking signal whereby the timing signal information is not transferred to the output thereof.

8. The circuit of claim 7 wherein said blanking circuit means includes:

comparator means having an output which is responsive to the magnitude of one of said control signals reaching a predetermined value sometime after the predetermined time interval after initiation of each individual periodic input signal for changing from a first level state to a second level state; and a first coincidence gate coupled to said output of said comparator means and receiving a second one of the control signals for producing said blanking signal at said output of said blanking circuit means upon coincidence of said second control signal and said comparator means output being in said first level state.

9. The circuit of claim 8 wherein said comparator means includes:

a current mirror circuit adapted to receive said first control signal and a reference potential at respective inputs, said current mirror circuit supplying an output current at an output thereof in response to said magnitude of said first control signal exceeding the magnitude of said reference potential; and output circuit means coupled between said output of said current mirror circuit and said output of said comparator means for causing the output of said comparator to switch to said second output level in response to said current supplied by said current mirror circuit to the input thereof.

10. The circuit of claim 9 wherein said output circuit includes a transistor having first, second and control electrodes, said first electrode being coupled to a terminal at which is supplied ground reference potential, said second electrode being coupled to said output of said comparator means, said control electrode being coupled to said output of said current mirror circuit.

11. The circuit of claim 10 wherein said first coincidence gate having a second output coupled to said coincidence circuit means.

12. The circuit of claim 11 wherein said coincidence circuit means includes:

a second coincidence gate having an input and output, said input being coupled to said input of said coincidence circuit means;

third and fourth coincidence gates each having an input and an output, said input of said third coincidence gate means being coupled to said input of said coincidence circuit means, said input of said fourth coincidence gate being coupled to said second output of said first coincidence gate and to said output of said second coincidence gate; and latch circuit means having first and second inputs respectively coupled to said outputs of said third and fourth coincidence gates and an output coupled to said output of the coincidence circuit means.

* * * * *